US009752468B2

(12) United States Patent
Muralidharan

(10) Patent No.: US 9,752,468 B2
(45) **Date of Patent: *Sep. 5, 2017**

(54) LOW-COST, HIGH-STRENGTH FE—NI—CR ALLOYS FOR HIGH TEMPERATURE EXHAUST VALVE APPLICATIONS

(71) Applicant: UT-Battelle, LLC, Oak Ridge, TN (US)

(72) Inventor: Govindarajan Muralidharan, Knoxville, TN (US)

( * ) Notice: Subject to any disclaimer, the term of this patent is extended or adjusted under 35 U.S.C. 154(b) by 333 days.

This patent is subject to a terminal disclaimer.

(21) Appl. No.: 14/497,550

(22) Filed: Sep. 26, 2014

(65) Prior Publication Data

US 2016/0090878 A1 Mar. 31, 2016

(51) Int. Cl.

| | |
|---|---|
| ***F01L 3/02*** | (2006.01) |
| ***C22C 19/05*** | (2006.01) |
| ***C22C 30/02*** | (2006.01) |
| ***C22C 30/00*** | (2006.01) |

(52) U.S. Cl.

CPC ..... *F01L 3/02* (2013.01); *C22C 19/056* (2013.01); *C22C 30/00* (2013.01); *C22C 30/02* (2013.01)

(58) Field of Classification Search

CPC ..... F01L 3/02; C22C 19/056
USPC ..... 123/188.3
See application file for complete search history.

(56) References Cited

U.S. PATENT DOCUMENTS

| | | | |
|---|---|---|---|
| 2,684,299 | A | 7/1954 | Binder et al. |
| 3,030,206 | A | 4/1962 | Buck, Jr. |
| 3,416,916 | A | 12/1968 | Herchenroeder et al. |
| 3,444,058 | A | 5/1969 | Mellors |
| 3,576,622 | A | 4/1971 | Mccoy |
| 3,785,877 | A | 1/1974 | Bailey |
| 3,811,960 | A | 5/1974 | Parry et al. |
| 3,917,463 | A | 11/1975 | Doi et al. |
| 3,985,582 | A | 10/1976 | Bibring et al. |
| 4,102,394 | A | 7/1978 | Botts |
| 4,194,909 | A | 3/1980 | Ohmura et al. |
| 4,476,091 | A | 10/1984 | Klarstrom |

(Continued)

FOREIGN PATENT DOCUMENTS

| | | | |
|---|---|---|---|
| CA | 706339 | A | 3/1965 |
| CA | 1215255 | A | 12/1986 |

(Continued)

OTHER PUBLICATIONS

Bruemmer, Stephen M. and Gary S. Was, Microstructural and Microchemical Mechanisms Controlling Intergranular Stress Corrosion Cracking in Light-Water-Reactor Systems, Journal of Nuclear Materials, 1994, pp. 348-363, vol. 216.

Weitzel, P.S. Steam Generator for Advanced Ulta-Supercritical Power Plants 700 to 760C, Technical Paper, 2011, 99. 1-12.

Khan, T., The Development and Characterization of a High Performance Experimental Single Crystal Superalloy, pp. 145-155.

Freche, J.C., et al., Application of Powder Metallurgy to an Advanced-Temperature Nickel-Base Alloy, NASA-TN D-6560, pp. 1-22.

Barner, J.H. Von et al., "Vibrational Spectra of Fluoro and Oxofluoro Complexes of Nb(V) and Ta(V)", Materials Science Forum vols. 73-75 (1991) pp. 279-284 © (1991) Trans Tech Publications, Switzerland doi:10.4028/www.scientific.net/MSF.73-75.279.

(Continued)

*Primary Examiner* — Weiping Zhu
(74) *Attorney, Agent, or Firm* — Fox Rothschild LLP

(57) ABSTRACT

An Fe—Ni—Cr alloy is composed essentially of, in terms of wt. %: 2.4 to 3.7 Al, up to 1.05 Co, 14.8 to 15.9 Cr, 25 to 36 Fe, up to 1.2 Hf, up to 4 Mn, up to 0.6 Mo, up to 2.2 Nb, up to 1.05 Ta, 1.9 to 3.6 Ti, up to 0.08 W, up to 0.03 Zr, 0.18 to 0.27 C, up to 0.0015 N, balance Ni, wherein, in terms of atomic percent: $8.5 \leq Al+Ti+Zr+Hf+Ta \leq 11.5$, $0.53 \leq Al \div (Al+Ti+Zr+Hf+Ta) \leq 0.65$, and $0.16 \leq Cr \div (Fe+Ni+Cr+Mn) \leq 0.21$, the alloy being essentially free of Cu, Si, and V.

20 Claims, 14 Drawing Sheets

(56) References Cited

U.S. PATENT DOCUMENTS

| | | | |
|---|---|---|---|
| 4,512,817 | A | 4/1985 | Duhl et al. |
| 4,652,315 | A | 3/1987 | Igarashi et al. |
| 4,740,354 | A | 4/1988 | Watanabe et al. |
| 4,765,956 | A | 8/1988 | Smith et al. |
| 4,818,486 | A | 4/1989 | Rothman et al. |
| 4,820,359 | A | 4/1989 | Bevilacqua et al. |
| 4,877,461 | A | 10/1989 | Smith et al. |
| 5,077,006 | A | 12/1991 | Culling |
| 5,167,732 | A | 12/1992 | Naik |
| 5,244,515 | A | 9/1993 | Miglin |
| 5,330,590 | A | 7/1994 | Raj |
| 5,529,642 | A | 6/1996 | Sugahara et al. |
| 5,567,383 | A | 10/1996 | Noda et al. |
| 5,585,566 | A | 12/1996 | Welles, II et al. |
| 5,660,938 | A | 8/1997 | Sato et al. |
| 5,718,867 | A | 2/1998 | Nazmy et al. |
| 5,779,972 | A | 7/1998 | Noda et al. |
| 5,788,783 | A | 8/1998 | Coutu et al. |
| 5,888,316 | A | 3/1999 | Erickson |
| 5,916,382 | A | 6/1999 | Sato et al. |
| 5,951,789 | A | 9/1999 | Ueta et al. |
| 6,099,668 | A | 8/2000 | Ueta et al. |
| 6,224,824 | B1 | 5/2001 | Zhang et al. |
| 6,344,097 | B1 | 2/2002 | Limoges et al. |
| 6,372,181 | B1 | 4/2002 | Fahrmann et al. |
| 6,610,154 | B2 | 8/2003 | Limoges et al. |
| 6,702,905 | B1 | 3/2004 | Qiao et al. |
| 6,797,232 | B2 | 9/2004 | Speidel et al. |
| 6,905,559 | B2 | 6/2005 | O'Hara et al. |
| 6,908,518 | B2 | 6/2005 | Bouse et al. |
| 7,011,721 | B2 | 3/2006 | Harris et al. |
| 7,038,585 | B2 | 5/2006 | Hall et al. |
| 7,042,365 | B1 | 5/2006 | Diaz-Lopez |
| 7,089,902 | B2 | 8/2006 | Sato et al. |
| 7,160,400 | B2 | 1/2007 | Magoshi et al. |
| 7,450,023 | B2 | 11/2008 | Muralidharan et al. |
| 7,507,306 | B2 | 3/2009 | Chen et al. |
| 7,824,606 | B2 | 11/2010 | Heazle |
| 7,825,819 | B2 | 11/2010 | Muralidharan et al. |
| 8,147,749 | B2 | 4/2012 | Reynolds |
| 8,313,591 | B2 | 11/2012 | Hirata et al. |
| 2003/0190906 | A1 | 10/2003 | Winick |
| 2004/0174260 | A1 | 9/2004 | Wagner |
| 2005/0053513 | A1 | 3/2005 | Pike |
| 2007/0152815 | A1 | 7/2007 | Meyers et al. |
| 2007/0152824 | A1 | 7/2007 | Waterhouse et al. |
| 2007/0152826 | A1 | 7/2007 | August et al. |
| 2007/0284018 | A1 | 12/2007 | Hamano et al. |
| 2008/0001115 | A1 | 1/2008 | Qiao et al. |
| 2008/0126383 | A1 | 5/2008 | Perrin et al. |
| 2009/0044884 | A1 | 2/2009 | Toschi et al. |
| 2009/0081073 | A1 | 3/2009 | Barbosa et al. |
| 2009/0081074 | A1 | 3/2009 | Barbosa et al. |
| 2009/0087338 | A1 | 4/2009 | Mitchell et al. |
| 2009/0194266 | A1 | 8/2009 | Conrad et al. |
| 2010/0008790 | A1 | 1/2010 | Reynolds |
| 2010/0116383 | A1 | 5/2010 | Cloue et al. |
| 2010/0303666 | A1 | 12/2010 | Bain et al. |
| 2010/0303669 | A1 | 12/2010 | Pankiw et al. |
| 2011/0236247 | A1 | 9/2011 | Osaki et al. |
| 2011/0272070 | A1 | 11/2011 | Jakobi et al. |
| 2012/0279351 | A1 | 11/2012 | Gu et al. |
| 2014/0271338 | A1 | 9/2014 | Holcomb et al. |

FOREIGN PATENT DOCUMENTS

| | | | | |
|---|---|---|---|---|
| CA | 2688507 | | 6/2011 | |
| CA | 2688647 | | 6/2011 | |
| CN | 100410404 | | 8/2008 | |
| CN | 202883034 | | 4/2013 | |
| EP | 1647609 | A1 | 4/2006 | |
| GB | 734210 | A | 7/1955 | |
| GB | 943141 | A | 11/1963 | |
| JP | 56084445 | | 7/1981 | |
| JP | 07109539 | | 4/1995 | |
| JP | 2012219339 | A | 11/2012 | |
| RU | 2479658 | | 4/2013 | |
| SE | WO 2009145708 | A1 * | 12/2009 | ..... G21C 3/34 |
| WO | 9206223 | A1 | 4/1992 | |
| WO | 2008005243 | | 1/2008 | |
| WO | 2013080684 | | 6/2013 | |

OTHER PUBLICATIONS

Devan, Jackson H. , "Effect of Alloying Additions on; Corrosion Behaviour of Nickel-Molybdenum Alloys in; Fused Fluoride Mixtures", ORNL-TM-2021, vol. I, J. H. DeVan;; Oak Ridge National Laboratory Central Research Library Document; Collection (May 1969).

Misra, Ajay K. et al., "Fluoride Salts and Container Materials for; Thermal Energy Storage Applications in the Temperature Range 973 to; 1400 K", 22nd Intersociety Energy Conversion Engineering Conference; cosponsored by the AIAA, ANS, ASME, SAE, IEEE, ACS, and AIChE; Philadelphia, Pennsylvania, Aug. 10-14, 1987. Department of; Metallurgy and Materials Science, Case Western Reserve University ,; Cleve.

Polyakova, L.P. et al., "Electrochemical Study of Tantalum in Fluoride; and Oxofluoride Melts", J. Electrochem. Soc., vol. 141, No. 11,; Nov. 1994 The Electrochemical Society Inc., pp. 2982-2988.

Singh, Raj P. , "Processing of Ta2O5 Powders for Electronic; Applications", Journal of Electronic Materials, vol. 30, No. 12, 2001, pp. 1584-1594.

Yoder, Graydon L. et al., "An experimental test facility to support; development of the fluoride-salt-cooled high-temperature reactor", Annals; of Nuclear Energy 64 (2014) 511-517.

Ignatiev et al.: "Alloys compatibility in molten salt fluorides: Kurchatov Institute related experience", Journal of Nuclear Materials, 441 (2013), 592-603.

Kondo et al.: "Corrosion characteristics of reduced activation ferritic steel, JLF-1 (8.92Cr—2W) in molten salts Flibe and Flinak, Fusion Engineering and Design", 84 (2009) 1081-1085.

Kondo et al.: "High Performance Corrosion Resistance of Nickel-Based Alloys in Molten Salt FLiBe", Fusion Science and Technology, 56, Jul. 2009, 190-194.

Delpech et al.: "MSFR: Material Issues and the Effect of Chemistry Control", GIF Symposium, Paris France, Sep. 9-10, 2009.

Liu et al.:"Investigation on corrosion behavior of Ni-based alloys in molten fluoride salt using synchrotron radiation techniques", Journal of Nuclear Materials, 440 (2013) 124-128.

Glazoff et al.: "Computational Thermodynamic Modeling of Hot Corrosion of Alloys Haynes 242 and HastelloyTM N for Molten Salt Service in Advanced High Temperature Reactors", Journal of Nuclear Energy Science & Power Generation Technology, 3(3), 2014.

Materials Compatibility for High Temperature Liquid Cooled Reactor Systems (RC-1) https://neup.inl.gov/SiteAssets/FY_2017_Documents/FY17_CINR_DRAFT_WORKSCOPES.pdf, Aug. 10, 2016 (see p. 5 of the document).

Zheng et al: "Corrosion of 316L Stainless Steel and Hastelloy N Superalloy in Molten Eutectic LiF—NaF—KF Salt and Interaction with Graphite", Nuclear Technology, 188(2), 2014, p. 192.

Zheng et al.: "Corrosion of 316 Stainless Steel in High Temperature Molten Li2BeF4 (FLiBe) Salt", Journal of Nuclear Materials, vol. 416, 2015, p. 143.

Olson et al.: Impact of Corrosion Test Container Material in Molten Fluorides, Journal of Solar Energy Engineering, v. 137(6), 061007, 2015.

Zheng et al: "High Temperature Corrosion of Hastelloy N in Molten Li2BeF4 (FLiBe) Salt", Corrosion, 71/10, 2015, p. 1257.

ASM Handbook, Formerly Tenth Edition, Metals Handbook, vol. 2 Properties and SElection: Nonferrous Alloys and Special-Purpose Materials, Oct. 1995.

* cited by examiner

LOW-COST, HIGH-STRENGTH FE—NI—CR ALLOYS FOR HIGH TEMPERATURE EXHAUST VALVE APPLICATIONS

STATEMENT REGARDING FEDERALLY SPONSORED RESEARCH

The United States Government has rights in this invention pursuant to contract no. DE-AC05-00OR22725 between the United States Department of Energy and UT-Battelle, LLC.

CROSS-REFERENCE TO RELATED APPLICATIONS

This patent application is related to U.S. patent application Ser. No. 14/307,733 filed on Jun. 18, 2014, entitled "Low-cost Fe—Ni—Cr Alloys for High Temperature Exhaust Valve Applications" which is being filed on even date herewith, the entire disclosure of which is incorporated herein by reference.

BACKGROUND OF THE INVENTION

Improvements in internal combustion engine efficiency alone have the potential to increase passenger vehicle fuel economy by 25 to 40 percent and commercial vehicle fuel economy by 30 percent with a concomitant reduction in carbon dioxide emissions. Certain higher performance engines need higher temperature-capable valve materials due to increased exhaust gas temperatures, higher exhaust flow rates, higher cylinder pressures, and/or modified valve timings. Target temperatures for experimental engines are currently exceeding current 760° C. with the potential to reach 1000° C.

There is a critical need to develop materials that meet projected operational performance parameters but also are feasible with respect to cost constraints. In particular, new low-cost, valve alloys with improved properties at temperatures from 870 to 1000° C. are required for the next generation, high efficiency automotive and diesel engines.

Ni-based alloys are attractive candidates for improved valve materials. High temperature yield, tensile, and fatigue strengths have been identified as critical properties in determining the performance of these alloys in the valve application. In general, conventional Ni-based alloys are strengthened through a combination of solid solution strengthening and precipitation strengthening mechanisms with the latter needed to achieve higher strengths at higher temperatures. In one class of Ni-based superalloys, primary strengthening is obtained through the homogeneous precipitation of ordered, $L1_2$ structured, $Ni_3(X)$-based intermetallic precipitates (where X can include Al, Ti, Nb, Ta or any combination of the foregoing) that are coherently embedded in a solid solution face centered cubic (FCC) matrix. In another class of Ni-based alloys, creep resistance is also achieved through the precipitation of fine carbides ($M_{23}C_6$, $M_7C_3$, $M_6C$ where M is primarily Cr with substitution of Mo, W, for example) and carbonitrides (M(C, N) where M can include Nb, Ti, Hf, Ta or any combination of the foregoing for example) within the matrix, and larger carbides on grain boundaries to prevent grain boundary sliding. Moreover, high temperature oxidation resistance in these alloys is obtained through additions of Cr and Al. In other alloys, a combination of both types of precipitates may be used for optimum properties.

An evaluation of the microstructure of various Ni-based alloys and correlation with limited information on the fatigue properties that are available show that the amount (in terms of volume percent or weight percent) of the γ' phase is likely to be a dominant factor in determining the performance of these alloys at high temperatures. Since the size of the strengthening precipitates is also critical, it is anticipated that the kinetics of coarsening this phase would also be influential in the long-term performance of the alloys in this application.

Several example commercial Ni-based alloy compositions are shown in Table 1. To obtain initial information on the microstructures of these alloys at equilibrium, thermodynamic calculations were carried out using JMatPro V4.1. Comparison of the results of the calculations showed that all alloys have a matrix of γ with the major strengthening phase as γ'. One or more carbide phases such as $M_{23}C_6$, MC, and $M_7C_3$ may also be present in different alloys. The primary difference between the microstructures of the various alloys is in the weight percent of the γ' phase at a given temperature and the highest temperature at which the γ' phase is stable in the different alloys.

Specific reference is made to U.S. Pat. No. 5,660,938, issued to Katsuaki Sato, et al. on Aug. 26, 1997 and entitled "Fe—Ni—Cr-Base Superalloy, Engine Valve and Knitted Mesh Supporter for Exhaust Gas Catalyzer." An Fe—Ni—Cr-base superalloy consists essentially of, by weight, up to 0.15% C, up to 1.0% Si, up to 3.0% Mn, 30 to 49% Ni, 10 to 18% Cr, 1.6 to 3.0% Al, one or more elements selected from Groups IVa and Va whose amount or total amount is 1.5 to 8.0%, the balance being Fe, optionally, minor amounts of other intentionally added elements, and unavoidable impurities. The optional other elements which can be intentionally added to or omitted from the alloy include Mo, W, Co, B, Mg, Ca, Re, Y and REM. The superalloy is suitable for forming engine valves, knitted mesh supporters for exhaust gas catalyzers and the like, and has excellent high-temperature strength and normal-temperature ductility after long-time heating, as well as sufficient oxidation resistance properties for these uses. The composition is required to satisfy the following Formulae (1) and (2) by atomic percent:

$$6.5 \leq Al+Ti+Zr+Hf+V+Nb+Ta \leq 10 \quad (1)$$

$$0.45 \leq Al/(Al+Ti+Zr+Hf+V+Nb+Ta) \leq 0.75 \quad (2)$$

Specific reference is made to U.S. Pat. No. 6,372,181, issued to Michael G. Fahrmann, et al. on Apr. 16, 2002 and entitled "Low cost, Corrosion and Heat Resistant Alloy for Diesel Engine Valves." A low cost, highly heat and corrosion resistant alloy useful for the manufacture of diesel engine components, particularly exhaust valves, comprises in % by weight about 0.15-0.65% C, 40-49% Ni, 18-22% Cr, 1.2-1.8% Al, 2-3% Ti, 0.9-7.8% Nb, not more than 1% Co and Mo each, the balance being essentially Fe and incidental impurities. The Ti:Al ratio is ≤2:1 and the Nb:C weight % ratio is within a range of 6:1 and 12:1. Ta may be substituted for Nb on an equiatomic basis.

BRIEF SUMMARY OF THE INVENTION

In accordance with one aspect of the present invention, the foregoing and other objects are achieved by a n Fe—Ni—Cr alloy is composed essentially of, in terms of wt. %: 2.4 to 3.7 Al, up to 1.05 Co, 14.8 to 15.9 Cr, 25 to 36 Fe, up to 1.2 Hf, up to 4 Mn, up to 0.6 Mo, up to 2.2 Nb, up to 1.05 Ta, 1.9 to 3.6 Ti, up to 0.08 W, up to 0.03 Zr, 0.18 to 0.27 C, up to 0.0015 N, balance Ni, wherein, in terms of atomic percent: $8.5 \leq Al+Ti+Zr+Hf+Ta \leq 11.5$, $0.53 \leq Al \div (Al+Ti+Zr+$ Hf+Ta)≤0.65, and 0.16≤Cr÷(Fe+Ni+Cr+Mn)≤0.21, the alloy being essentially free of Cu, Si, and V.

Figure 1:
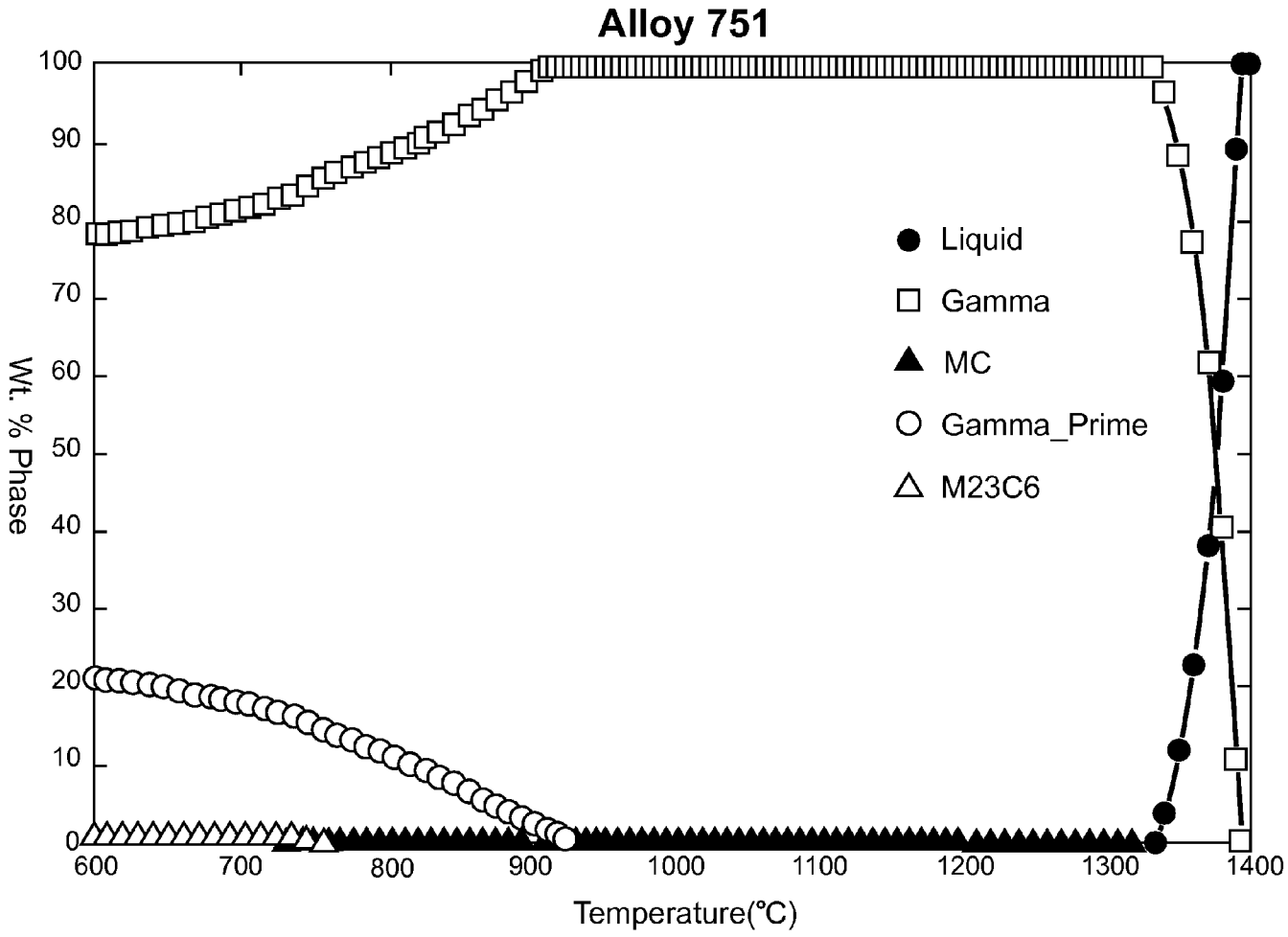
FIG. 1 is a graph showing phase equilibria for Alloy 751 as a function of temperature (nitrogen and boron are not included in the calculations).

For a better understanding of the present invention, together with other and further objects, advantages and capabilities thereof, reference is made to the following disclosure and appended claims in connection with the above-described drawings.

DETAILED DESCRIPTION OF THE INVENTION

Computational thermodynamics was used to identify new, lower cost alloys with microstructure similar to the commercial alloys and having comparable properties. In contrast to the comparable, commercially available alloys with Ni+Co content greater 60 wt. %, Ni+Co content in the new alloys ranges from about 30 wt. % to 51 wt. % with the potential to achieve comparable properties. This implies that the alloys will be of lower cost with the potential to achieve targeted fatigue life. For example a well-known, commonly used valve alloy known as "Alloy 751" has about 71 wt. % Ni+Co as shown in Table 1.

Constraints in Alloy Development: The alloys used for valve materials should have high strength, good oxidation resistance, should have sufficient ductility at high temperatures to be shaped into valves. They should also have high volume fraction of γ' to achieve strengths at high temperature along with the lowest possible coarsening rates to maintain strength for the longest period of time. The following elements are added to achieve the appropriate benefits:

Nickel: Primary addition, certain amount of nickel is required to achieve beneficial strength, and ductility properties. Higher the temperature of operation, greater is the amount of Ni required.

Iron: Addition of element minimizes cost of alloy. Provides solid solution strengthening. Too much addition can destabilize austenitic matrix.

Chromium: At least 15 wt. % is critically required in the compositions to ensure good oxidation resistance but limited to 20 wt. % to minimize formation of undesirable BCC phase or other brittle intermetallics.

Aluminum+Titanium: Provides primary strengthening through the formation of γ' precipitates. Ratio of aluminum to other elements such as Ti, Nb, and Ta changes the high temperature stability of the γ' precipitates, strengthening achievable for an average precipitate size, and the anti-phase boundary (APB) energy. Aluminum also provides oxidation resistance with lower amounts required when added in combination with Cr.

Niobium: Forms stable MC-type carbides, also can segregate to γ' and affect high temperature stability and coarsening rate of γ', affects APB energy, decreases creep rate due to precipitation of carbides.

Tantalum: Forms stable MC-type carbides, also can segregate to γ' and affect high temperature stability and coarsening rate of γ', lower average interdiffusion coefficient in the matrix, affects APB energy, decreases creep rate due to precipitation of carbides.

Molybdenum: Added for solid solution strengthening, also is the primary constituent in $M_6C$ carbides. Decreases average interdiffusion coefficient. Too much addition can result in the formation of undesirable, brittle intermetallic phases and can reduce oxidation resistance Manganese: Stabilizes the austenitic matrix phase. Provides solid solution strengthening and also helps in trapping sulfur.

Carbon, Nitrogen: Required for the formation of carbide and carbo-nitride phases that can act as grain boundary pinning agents to minimize grain growth and to provide resistance to grain boundary sliding. Fine precipitation of carbides and carbonitrides can increase high temperature strength and creep resistance.

Cobalt: Provides solid solution strengthening.

Tungsten: Provides solid solution strengthening and decreases average interdiffusion coefficient. Too much can result in the formation of brittle intermetallic phases.

Typically, Ni-based alloys are strengthened through a combination of solid solution strengthening, and precipitation strengthening. The primary advantage of solid solution strengthened alloys is microstructural stability. Since strengthening is primarily obtained through the presence of solute elements in solid solution that may be different in size, and chemical composition from the solvent and not through the presence of precipitates, microstructural changes such as coarsening of precipitates will not be relevant in determining the properties of these alloys. Furthermore, fabrication such as forming and welding operations are simpler due to solid-solution strengthening being the primary strengthening mechanism. However, solid solution strengthened alloys can be primarily used in applications that need relatively lower yield and tensile strengths and lower creep strength when compared to precipitation-strengthened alloys but require consistent properties for long periods of time. Thus the γ'-strengthened alloys provide the higher strength required for applications for which the solid solution strengthened alloys have insufficient strength. One disadvantage with γ' alloys is that the strength decreases with time at temperature due to the coarsening of γ' precipitates with time. The rate of loss of strength is directly related to the rate of growth of precipitates which increases with increase in temperature (which also results in an increase in interdiffusion coefficients).

The strengthening potential of γ' is determined by various factors with the major factors being the volume fraction, size and particle size distribution, lattice parameter misfit between the γ and γ' phases, and the antiphase boundary energy. The compositions of the alloys determine the wt. % of γ' and compositions of the γ and γ' phases as a function of temperature which affect the lattice parameter misfit, and antiphase boundary energy. The heat-treatment conditions determine the size and size distribution of the strengthening phase. Diffusion coefficients and lattice parameter misfit have a strong influence on the coarsening of the γ' phase.

The alloys described herein were designed to: (1) maximize γ' content at a temperature higher than prior alloys of this type and particularly at a temperature of 870° C., (2) maximize the strengthening potential of γ' which is related to the compositions of the phases present at higher temperatures, (3) include elements that minimize the coarsening rate of γ', and (4) precipitate small amounts of carbides for grain size control and creep minimization. Broadest constituent ranges for alloys of the present invention are set forth in Table 2. The alloys of the present invention are essentially free of Cu, Si, and V, except for insignificant amounts as incidental impurities. Some examples thereof are set forth in Table 3, with Alloy 751 for comparison.

Quantities A, B, and C are atomic percent values defined as follows (all in at. %):

$$A = \mathrm{Al+Ti+Zr+Hf+Ta} \quad (3)$$

$$B = \mathrm{Al} \div (\mathrm{Al+Ti+Zr+Hf+Ta}) \quad (4)$$

$$C = \mathrm{Cr} \div (\mathrm{Ni+Fe+Cr+Mn}) \quad (5)$$

The formulae are calculated in atomic %, and then converted to weight % for facilitation of manufacture. Quantity A generally represents an indication of the amount of γ precipitates that can form in the alloy compositions and must be in the range of 8.5 to 11.5, preferably in the range of 8.7 to 11.48, more preferably in the range of 9 to 11.45.

Quantity B generally represents an indication of a ratio of Al to other elements in γ' precipitates that can form in the alloy compositions and must be in the range of 0.53 to 0.65, preferably in the range of 0.54 to 0.64, more preferably in the range of 0.55 to 0.63.

Quantity C represents a critical relationship between Cr and certain other elements in the alloy compositions. Quantity C generally represents an indication of the composition of the matrix (γ), and the lattice misfit between the matrix (γ) and the precipitate (γ'), and must be in the range of 0.16 to 0.21, preferably in the range of 0.17 to 0.20, more preferably in the range of 0.18 to 0.19.

Another characteristic that may be considered is the lattice misfit between γ and γ', generally defined as $$2(a_{\gamma'} - a_{\gamma})/(a_{\gamma'} + a_{\gamma}) \quad (6)$$

where $a_{\gamma'}$ represents the lattice parameter of γ' and $a_{\gamma}$ represents the lattice parameter of γ. The calculated value represents an indication of the contribution to hardening (e.g., yield and tensile strengths) from coherency strains between the precipitate and the matrix of the alloy composition. The lattice misfit for alloys of the present invention at 870° C. can be expected to fall within the range of −0.35% to +0.14%, preferably in the range of −0.34% and +0.139%, more preferably in the range of −0.325% and +0.137%, as shown in Table 6.

EXAMPLES

Alloys 41M, 66, 67, 490-2, 490-3, and 41M3, shown in Table 3, were made using well-known, conventional methods. Vacuum arc cast ingots were annealed at 1200° C. in an inert gas environment (vacuum can also be used). The ingots were then hot-rolled into plates for mechanical testing. A solution annealing treatment was performed at 1150° C. for 1 hour. Thus, all the alloys can be cast, heat-treated, and mechanically processed into plates and sheets. The skilled artisan will recognize that other, conventional heat-treatment schedules can be used.

Figure 2:
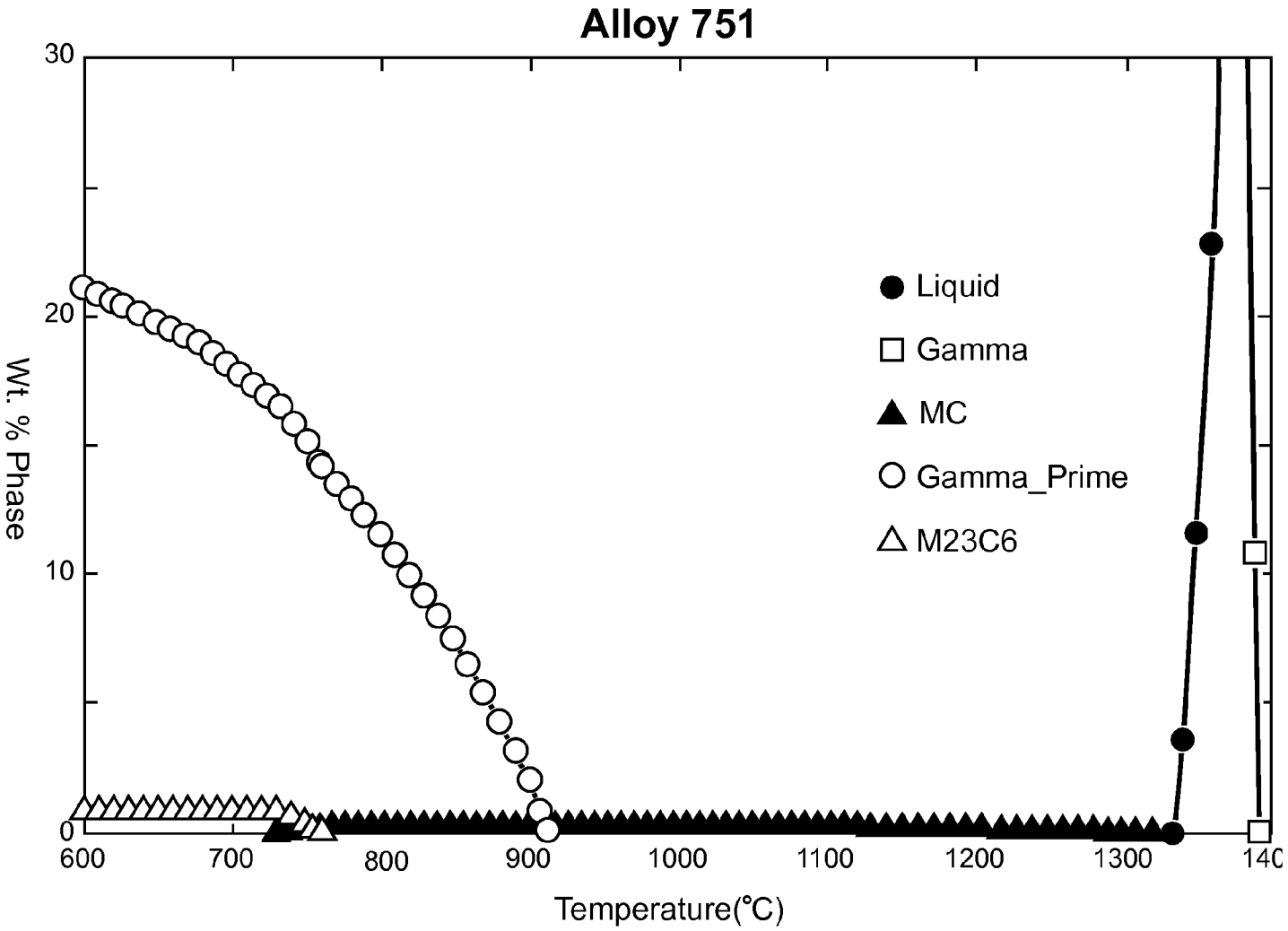
FIG. 2 is an expanded view of a portion of the graph shown in FIG. 1 to show details.
Figure 3:
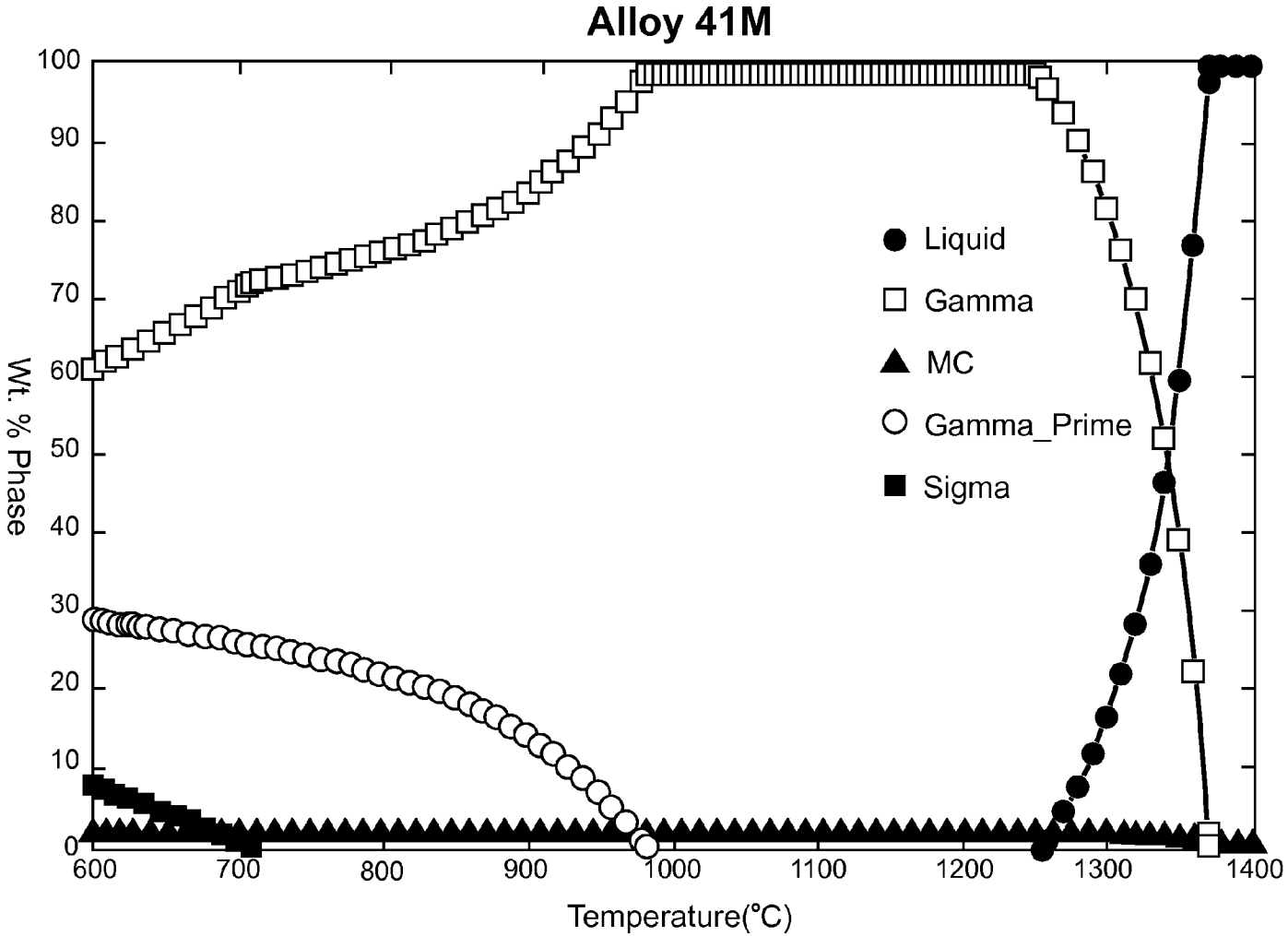
FIG. 3 is a graph showing phase equilibria for Alloy 41M as a function of temperature (nitrogen and boron are not included in the calculations).
Figure 4:
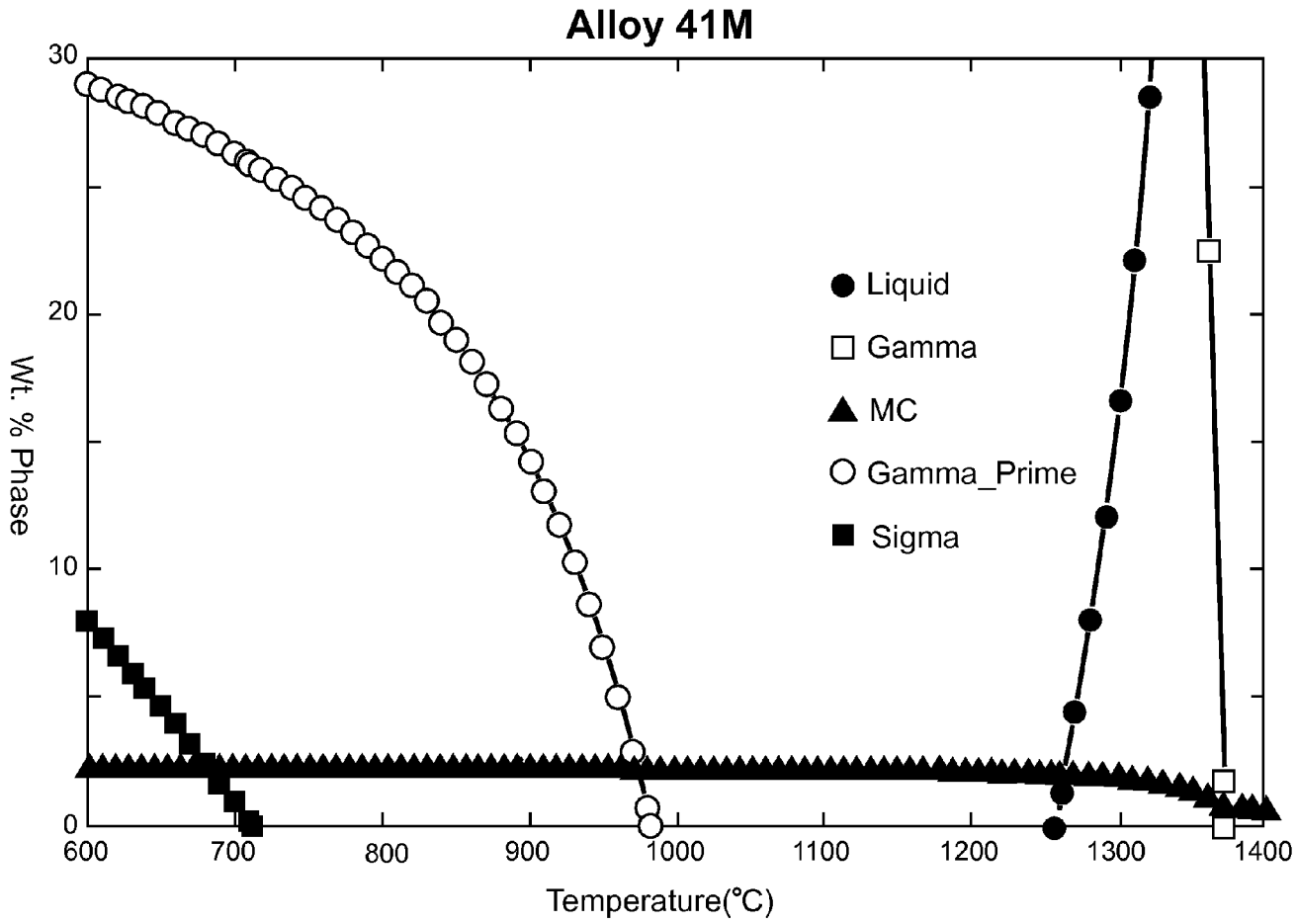
FIG. 4 is an expanded view of a portion of the graph shown in FIG. 3 to show details.
Figure 5:
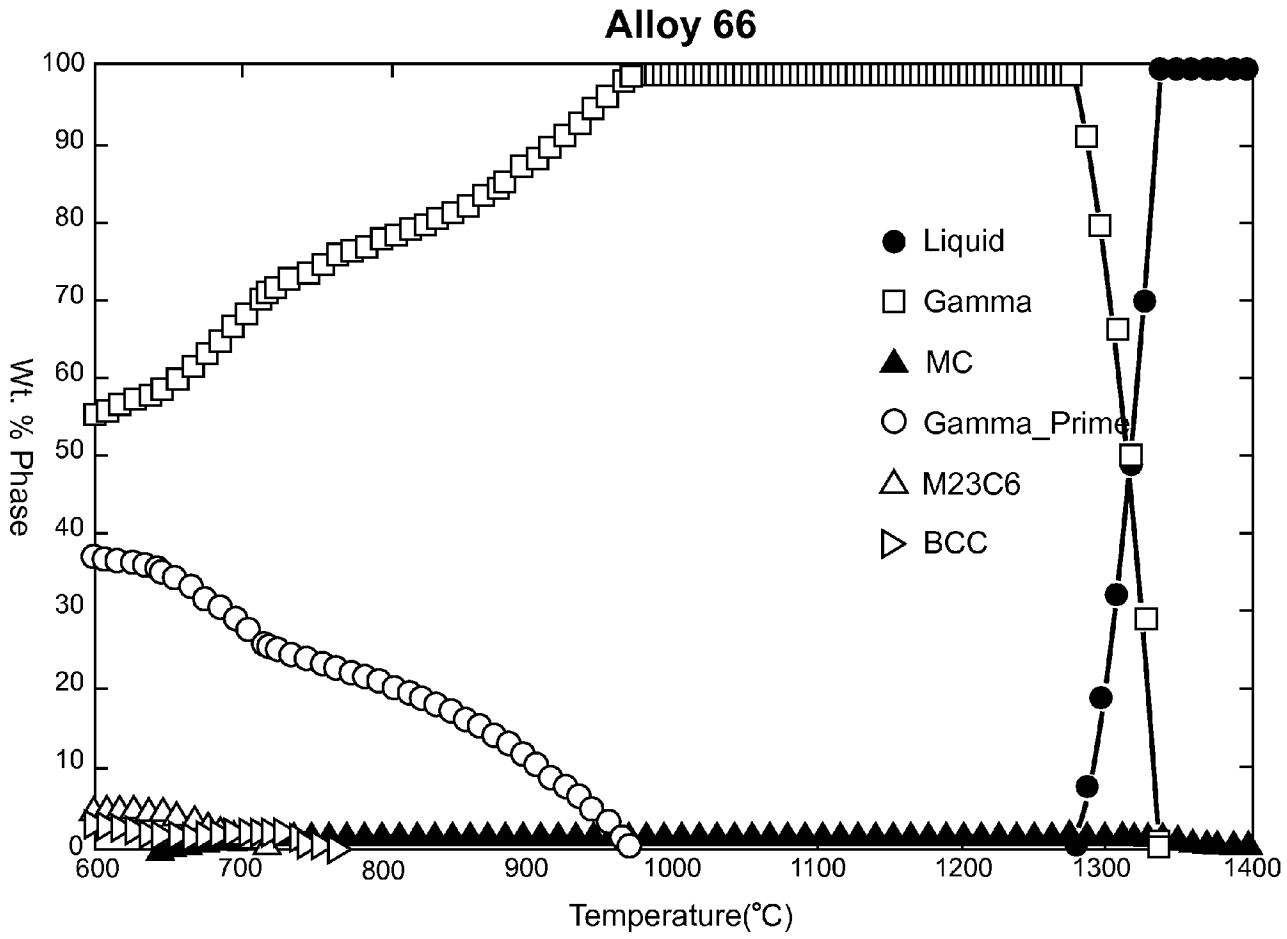
FIG. 5 is a graph showing phase equilibria for Alloy 66 as a function of temperature (nitrogen and boron are not included in the calculations).
Figure 6:
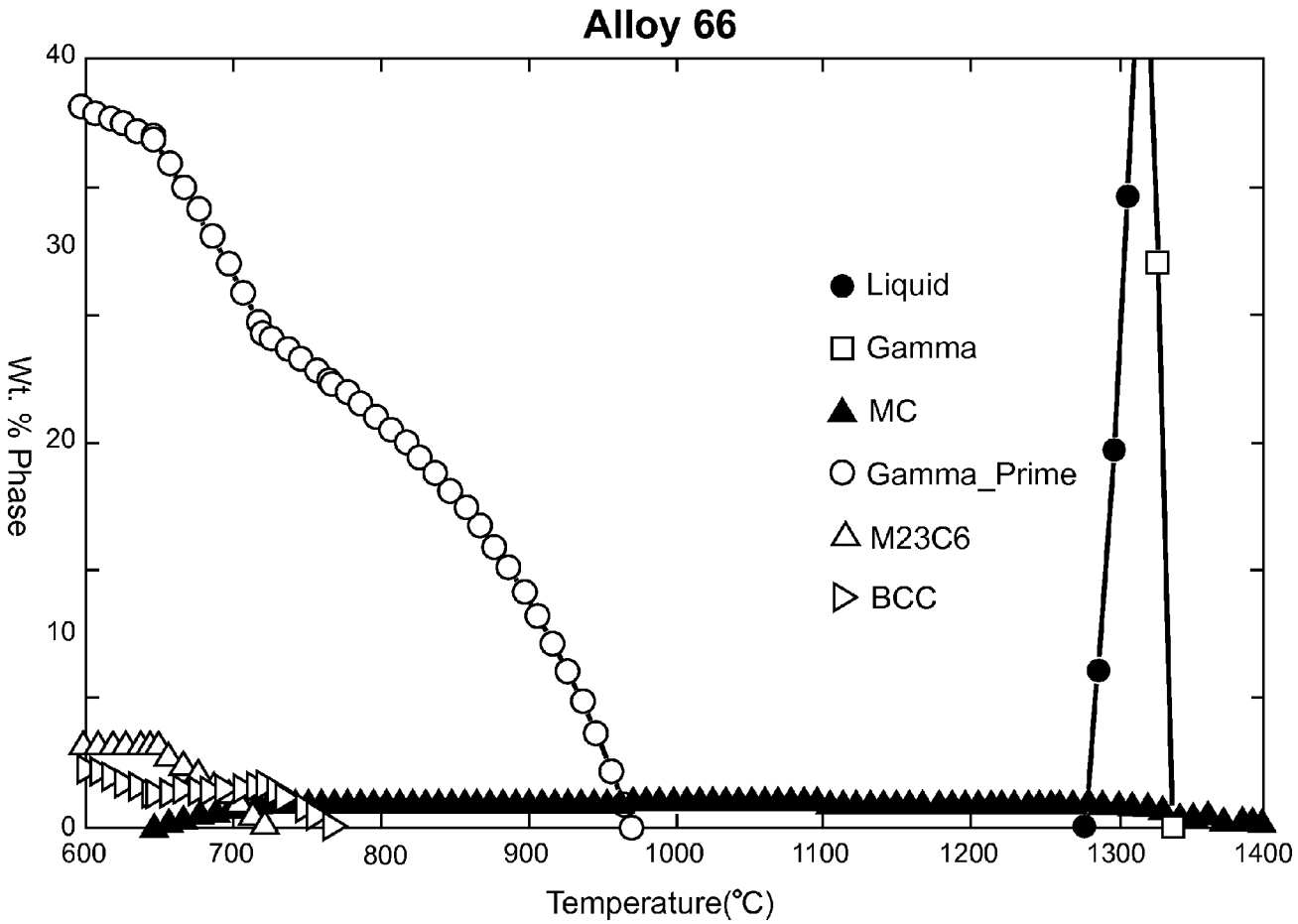
FIG. 6 is an expanded view of a portion of the graph shown in FIG. 5 to show details.
Figure 7:
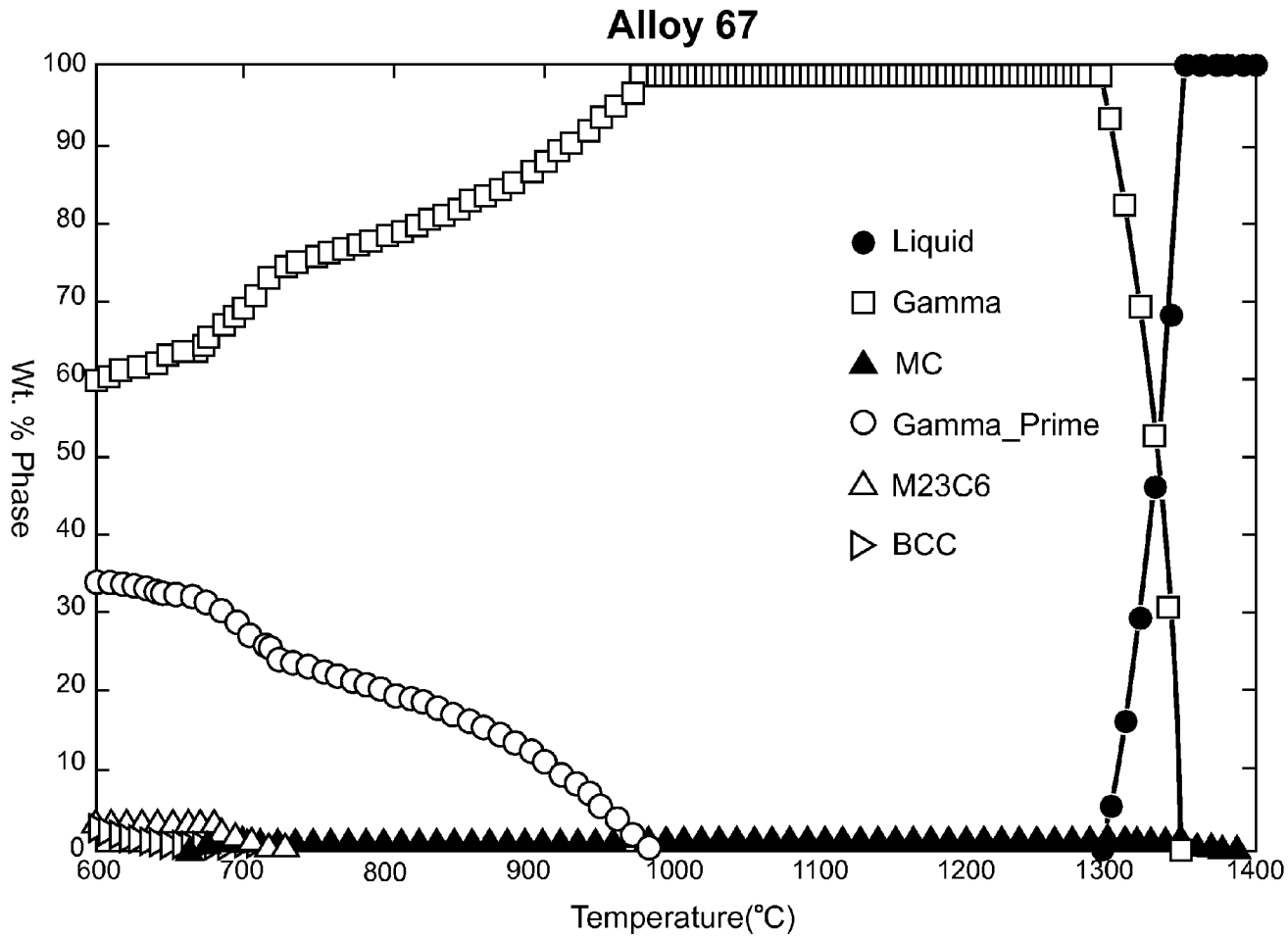
FIG. 7 is a graph showing phase equilibria for Alloy 67 as a function of temperature (nitrogen and boron are not included in the calculations).
Figure 8:
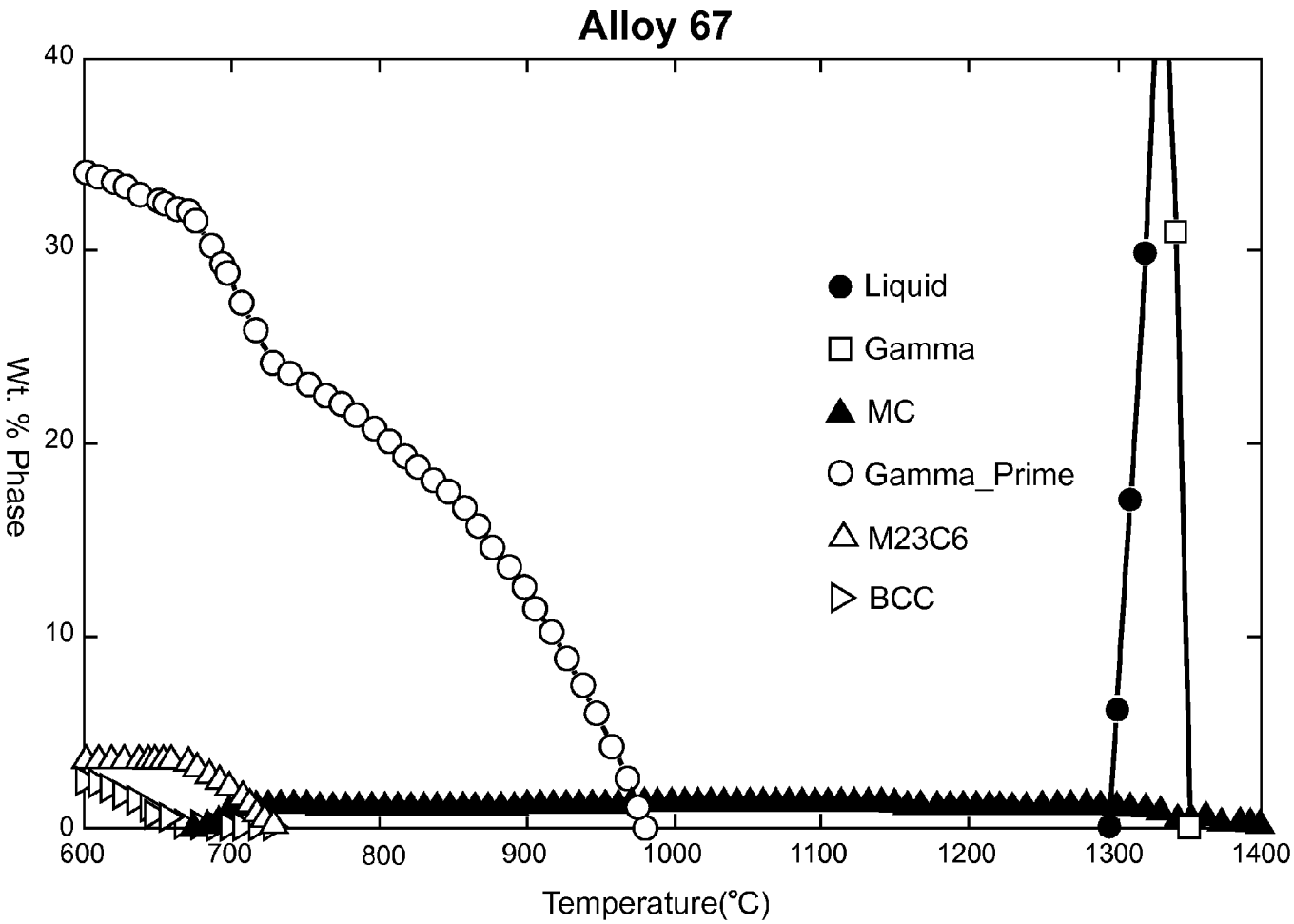
FIG. 8 is an expanded view of a portion of the graph shown in FIG. 7 to show details.
Figure 9:
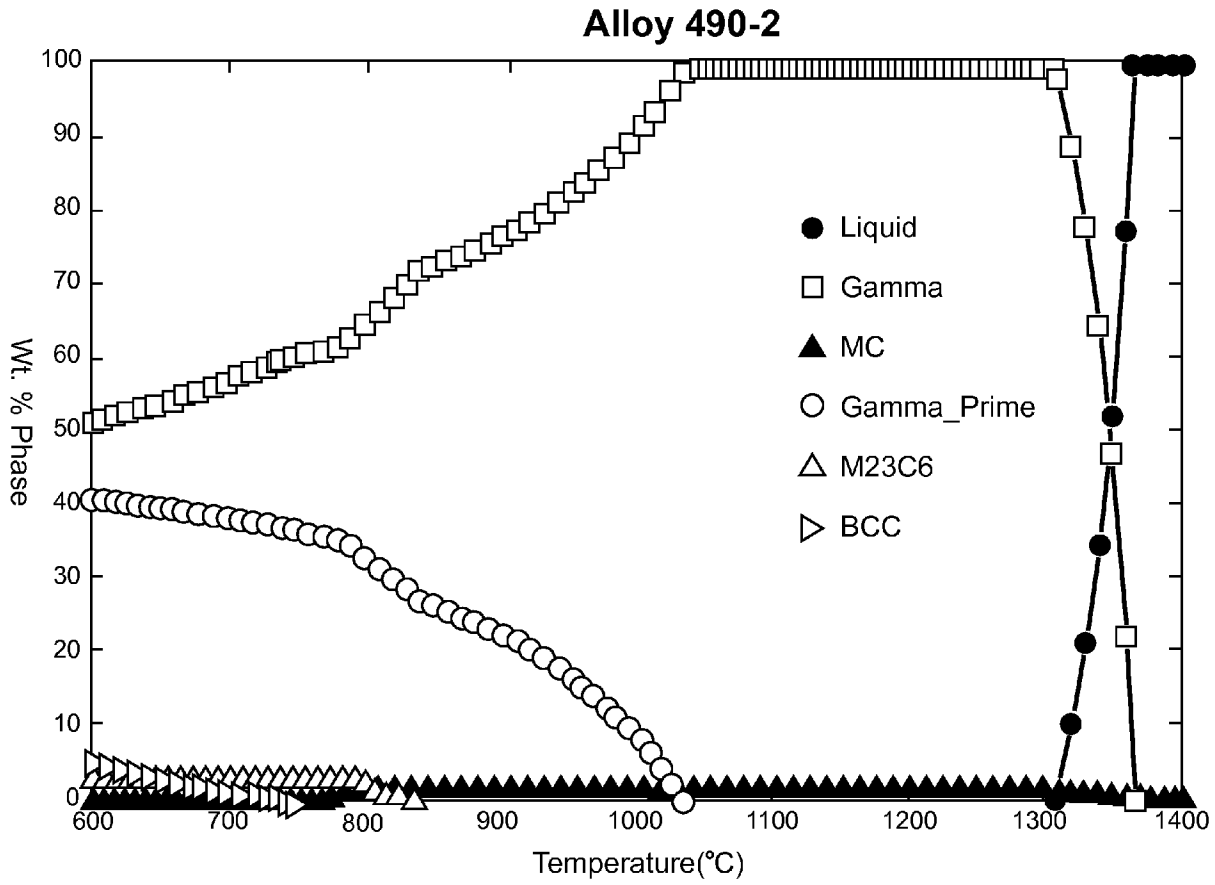
FIG. 9 is a graph showing phase equilibria for Alloy 490-2 as a function of temperature (nitrogen and boron are not included in the calculations).
Figure 10:
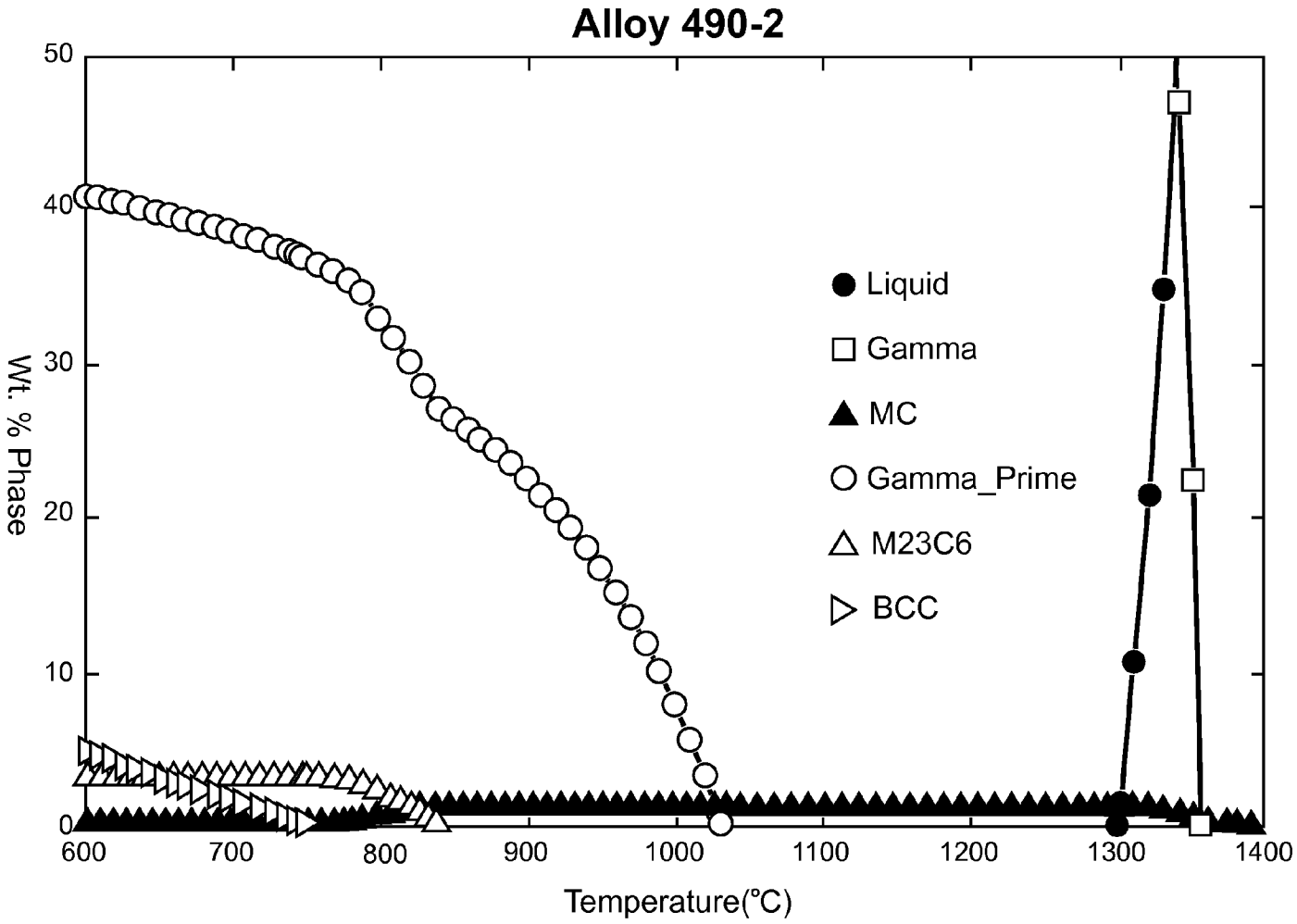
FIG. 10 is an expanded view of a portion of the graph shown in FIG. 9 to show details.
Figure 11:
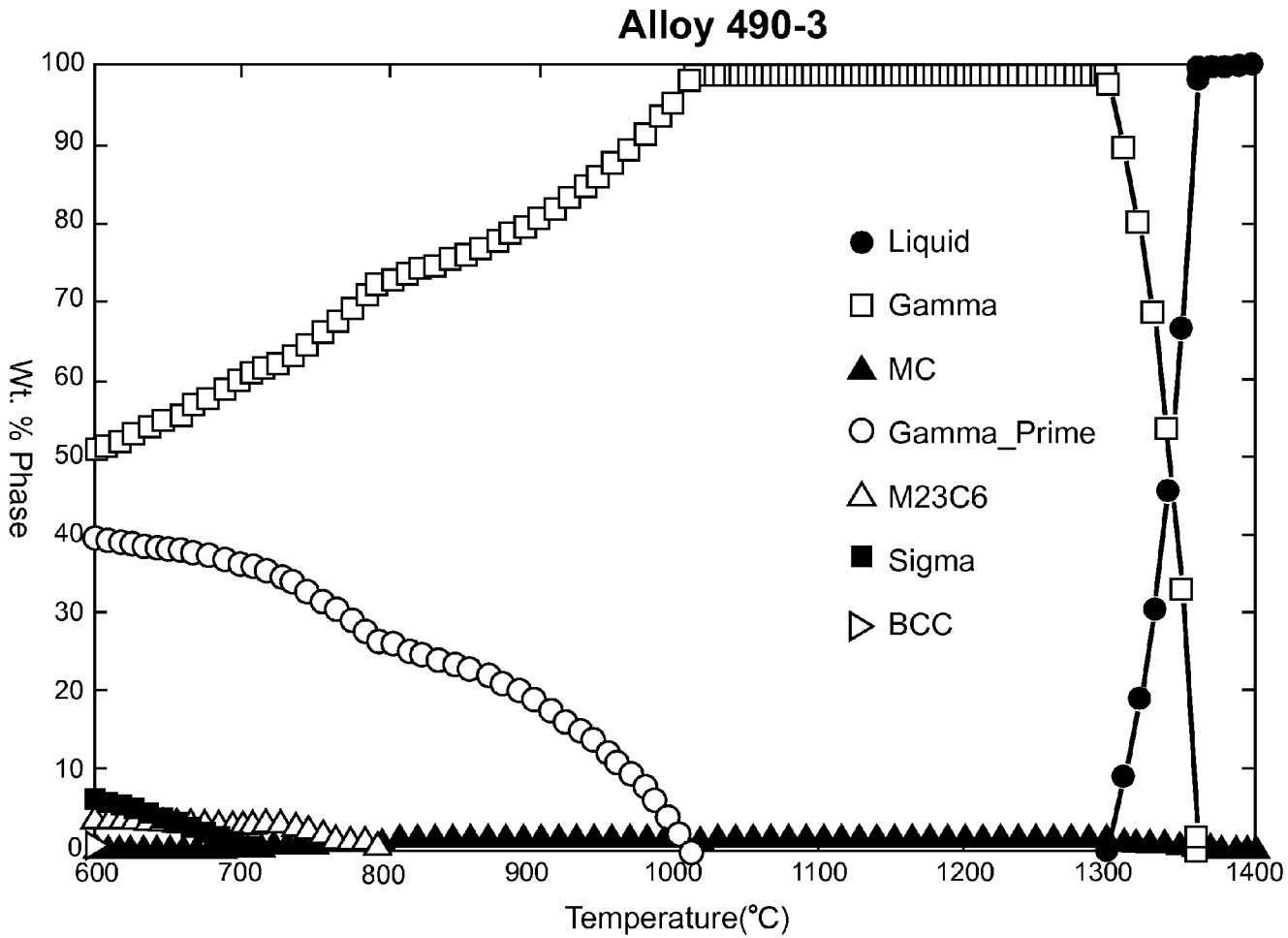
FIG. 11 is a graph showing phase equilibria for Alloy 490-3 as a function of temperature (nitrogen and boron are not included in the calculations).
Figure 12:
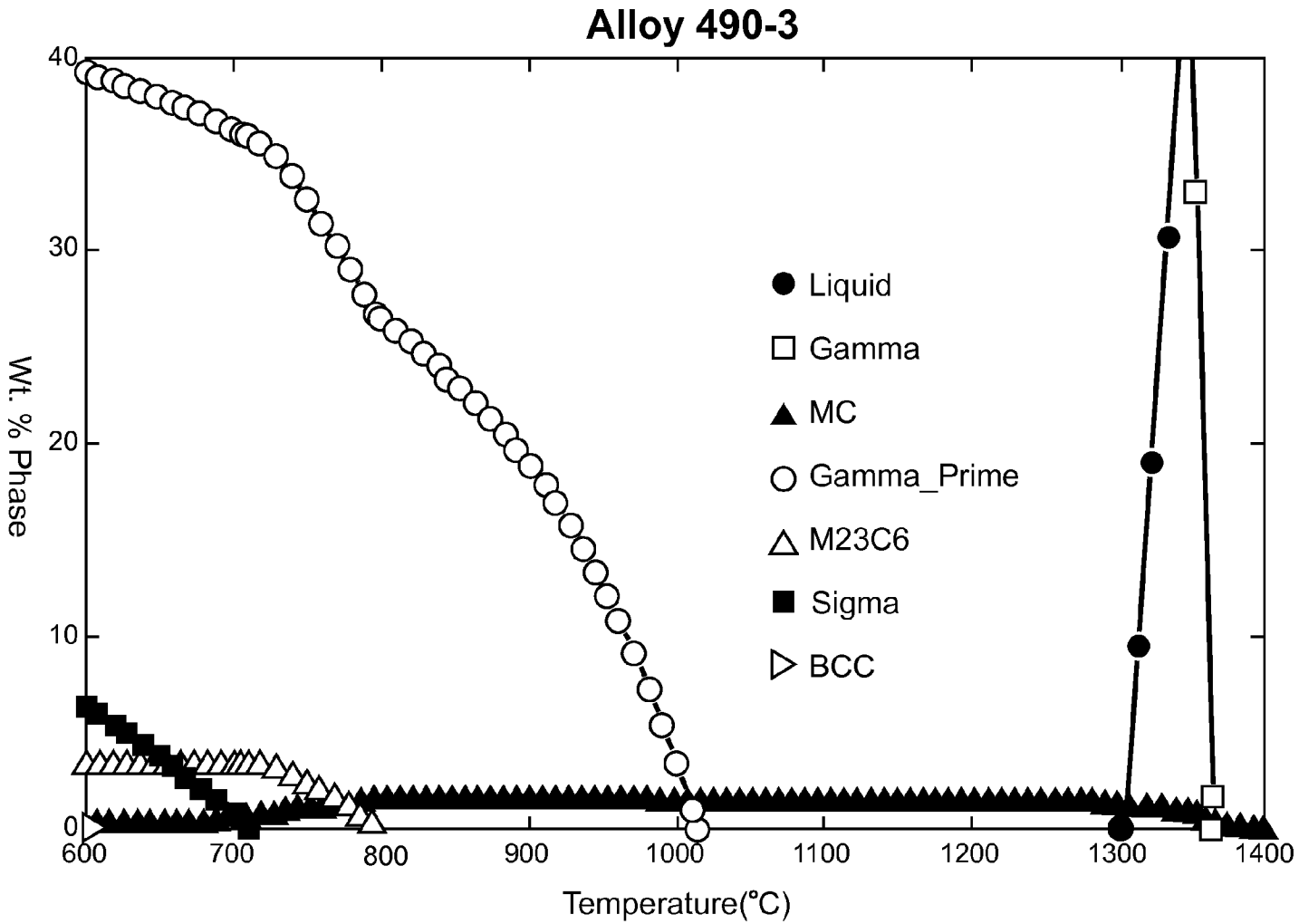
FIG. 12 is an expanded view of a portion of the graph shown in FIG. 11 to show details.
Figure 13:
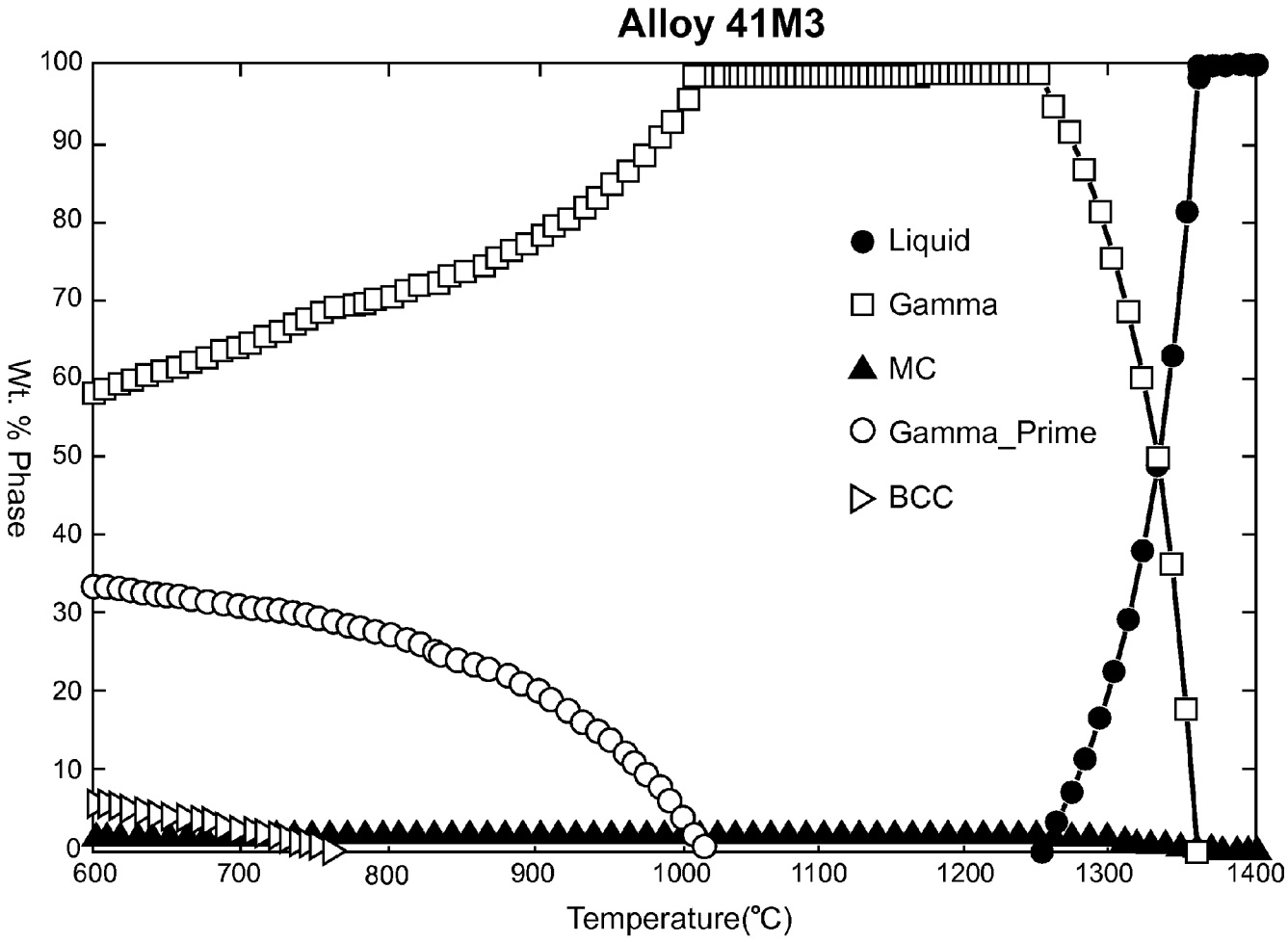
FIG. 13 is a graph showing phase equilibria for Alloy 41M3 as a function of temperature (nitrogen and boron are not included in the calculations).
Figure 14:
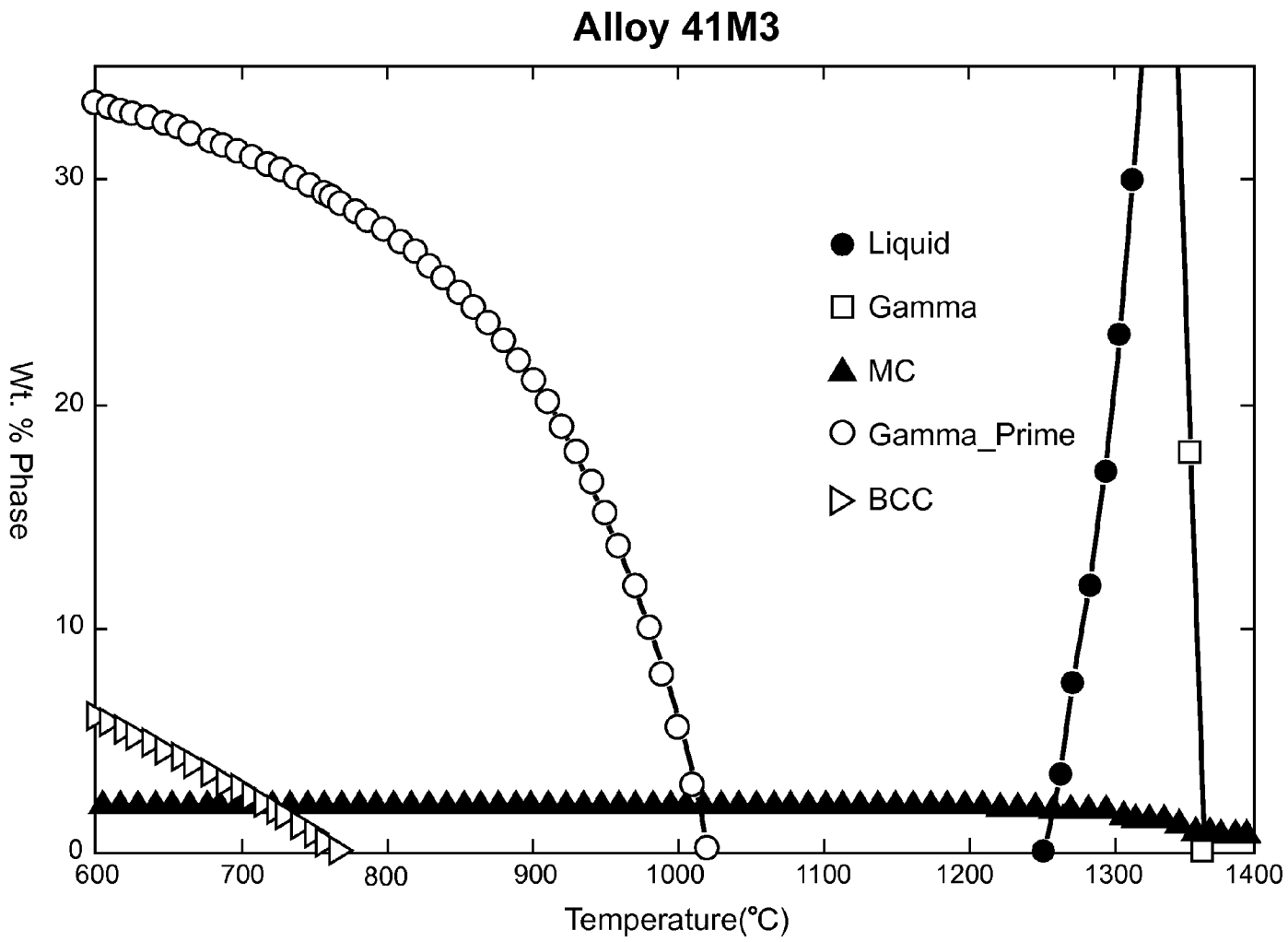
FIG. 14 is an expanded view of a portion of the graph shown in FIG. 13 to show details.

Table 2 shows the compositions of the new alloys while specific examples are shown in Table 3. FIGS. 3-14 show the results from equilibrium calculations obtained from the computational thermodynamics software JMatPro v 6.2 for specific examples shown in Table 3. Actual compositions, when available, were used for all the calculations. FIGS. 1-2 show the same for Alloy 751 for comparison.

Table 4 shows a summary of the volume fraction of the various alloys at 870° C. The wt. % of the primary strengthening phase γ' varies from 15.45% to 24.9 wt. %.

Table 5 shows the yield strength at room temperature and at 870° C. for the new alloys and the baseline alloy 751. At 870° C. the new alloys have yield strengths about 7.4% to 59.82% better than that of the baseline alloy 751.

Table 6 shows the variation of quantities A, B, and C, and calculated lattice misfit between γ and γ' at 870° C.

Tables 7 and 8 show the respective compositions of γ and γ' in each invention alloy at 870° C., all in at. %. The data show that these compositions affect strength and oxidation properties of alloys at 870° C.

While there has been shown and described what are at present considered to be examples of the invention, it will be obvious to those skilled in the art that various changes and modifications can be prepared therein without departing from the scope of the inventions defined by the appended claims.

TABLE 1

Compositions of several commercial Ni-based alloys (in weight %).

| Alloy | C | Si | Mn | Al | Co | Cr | Cu | Fe | Mo | Nb | Ni | Ta | Ti | W | Zr |
|---|---|---|---|---|---|---|---|---|---|---|---|---|---|---|---|
| X750 | 0.03 | 0.09 | 0.08 | 0.68 | 0.04 | 15.7 | 0.08 | 8.03 | — | 0.86 | Bal | 0.01 | 2.56 | — | — |
| Nimonic 80A | 0.08 | 0.1 | 0.06 | 1.44 | 0.05 | 19.6 | 0.03 | 0.53 | — | — | Bal | — | 2.53 | — | — |
| IN 751 | 0.03 | 0.09 | 0.08 | 1.2 | 0.04 | 15.7 | 0.08 | 8.03 | — | 0.86 | Bal | 0.01 | 2.56 | — | — |
| Nimonic 90 | 0.07 | 0.18 | 0.07 | 1.4 | 16.1 | 19.4 | 0.04 | 0.51 | 0.09 | 0.02 | Bal | — | 2.4 | — | 0.07 |
| Waspaloy | 0.03 | 0.03 | 0.03 | 1.28 | 12.5 | 19.3 | 0.02 | 1.56 | 4.2 | — | Bal | — | 2.97 | — | 0.05 |
| Rene 41 | 0.06 | 0.01 | 0.01 | 1.6 | 10.6 | 18.4 | 0.01 | 0.2 | 9.9 | — | Bal | — | 3.2 | — | — |

TABLE 1-continued

Compositions of several commercial Ni-based alloys (in weight %).

| Alloy | C | Si | Mn | Al | Co | Cr | Cu | Fe | Mo | Nb | Ni | Ta | Ti | W | Zr |
|---|---|---|---|---|---|---|---|---|---|---|---|---|---|---|---|
| Udimet 520 | 0.04 | 0.05 | 0.01 | 2.0 | 11.7 | 18.6 | 0.01 | 0.59 | 6.35 | — | Bal | — | 3.0 | — | — |
| Udimet 720 | 0.01 | 0.01 | 0.01 | 2.5 | 14.8 | 15.9 | 0.01 | 0.12 | 3.0 | 0.01 | Bal | — | 5.14 | 1.23 | 0.03 |
| Alloy 617 | 0.07 | 0 | 0 | 1.2 | 12.5 | 22 | 0 | 1 | 9 | 0 | 54 | 0 | 0.3 | 0 | 0 |

TABLE 2

General compositions of new alloys.

| Element | Minimum wt. % | Maximum wt. % |
|---|---|---|
| Al | 2.4 | 3.7 |
| Co | 0 | 1.05 |
| Cr | 14.8 | 15.9 |
| Fe | 25 | 36 |
| Hf | 0 | 1.2 |
| Mn | 0 | 4 |
| Mo | 0 | 0.6 |
| Nb | 0 | 2.2 |
| Ta | 0 | 1.05 |
| Ti | 1.9 | 3.6 |
| W | 0 | 0.08 |
| Zr | 0 | 0.03 |
| C | 0.18 | 0.27 |
| N | 0 | 0.0015 |
| Ni | Balance | |

TABLE 5

Yield Strength of New Alloys and Improvement over baseline Alloy 751.

| Alloy | Yield Strength at RT (in psi) | Yield Strength at 870° C. (in psi) | % Improvement in Yield Strength at 870° C. |
|---|---|---|---|
| Alloy 751* | 127500 | 49091 | 0 |
| Alloy 41M | 140533 | 56290 | 14.66 |
| Alloy 66 | 133308 | 52724 | 7.40 |
| Alloy 67 | 138714 | 59230 | 20.65 |
| Alloy 490-2 | 143799 | 68801 | 40.15 |
| Alloy 490-3 | 142432 | 66663 | 35.80 |
| Alloy 41M3 | 145388 | 78455 | 59.82 |

*For comparison

TABLE 3

Compositions of new alloys compared to commercial alloys (analyzed compositions in wt. %)

| Alloy | Ni | Al | Co | Cr | Cu | Fe | Hf | Mn | Mo | Nb | Si | Ta | Ti | W | Zr | C | N |
|---|---|---|---|---|---|---|---|---|---|---|---|---|---|---|---|---|---|
| Alloy 751* | 71.71 | 1.1 | 0 | 15.8 | 0 | 7.88 | 0 | 0.1 | | 0.9 | 0.1 | 0 | 2.36 | 0 | 0 | 0.05 | 0 |
| Sato-19* | 48.3 | 2.01 | 0 | 11.2 | 0 | 32.09 | 0 | 2.15 | 0.35 | 0 | 0.05 | 0 | 3.61 | 0.13 | 0 | 0.114 | — |
| Alloy 41M | 40.32 | 2.5 | 1 | 15 | 0 | 35 | 1 | 0 | 0 | 2 | 0 | 1 | 2 | 0 | 0 | 0.18 | 0 |
| Alloy 66 | 44.8295 | 3.41 | 0 | 14.93 | 0 | 29.66 | 0 | 3.38 | 0 | 0 | 0 | 0 | 3.49 | 0.06 | 0 | 0.24 | 0.0005 |
| Alloy 67 | 45.22 | 2.96 | 0 | 15.06 | 0 | 30.72 | 0 | 2.42 | 0 | 0 | 0 | 0 | 3.42 | 0 | 0 | 0.2 | 0.0006 |
| Alloy 490-2 | 49.6589 | 3.56 | 0.02 | 15.56 | 0 | 25.87 | 0.21 | 0 | 0.52 | 0 | 0 | 1.02 | 3.4 | 0 | 0 | 0.18 | 0.0011 |
| Alloy 490-3 | 46.659 | 3.36 | 0.02 | 14.98 | 0 | 29.63 | 0.23 | 0 | 0.5 | 0 | 0 | 0.98 | 3.4 | 0.04 | 0 | 0.2 | 0.001 |
| Alloy 41M3 | 44.7693 | 2.83 | 1.01 | 15.76 | 0 | 29.13 | 0.9 | 0 | 0 | 1.94 | 0 | 0.99 | 2.44 | 0.03 | 0.02 | 0.18 | 0.0007 |

*For comparison

TABLE 4

Predictions of Equilibrium Phase Fractions (in weight %) of Various Alloys at 870° C.

| Alloy | γ | γ' | MC |
|---|---|---|---|
| Alloy 751* | 94.31 | 5.37 | 0.32 |
| Alloy 41M | 80.38% | 17.32% | 2.3% |
| Alloy 66 | 83.16% | 15.53% | 1.3% |
| Alloy 67 | 83.44% | 15.45% | 1.07% |
| Alloy 490-2 | 73.67% | 24.9% | 1.44% |
| Alloy 490-3 | 76.74% | 21.67% | 1.59% |
| Alloy 41M3 | 74.28% | 23.52 | 2.2% |

*For comparison

TABLE 6

Comparison of Atomic % Values Obtained from Formulae (3), (4) and (5) for the New Alloys.

| Alloy | A = Al + Ti + Zr + Hf + Ta | B = Al ÷ (Al + Ti + Zr + Hf + Ta) | C = Cr ÷ (Ni + Fe + Cr + Mn) | Calculated Lattice Misfit between γ and γ' at 870° C. |
|---|---|---|---|---|
| Sato-19* | 8.250 | 0.51 | 0.13 | −0.145% |
| Alloy 41M | 9.280 | 0.55 | 0.18 | +0.137% |
| Alloy 66 | 10.690 | 0.63 | 0.17 | −0.325% |
| Alloy 67 | 9.778 | 0.61 | 0.18 | −0.242% |
| Alloy 490-2 | 11.404 | 0.63 | 0.19 | −0.201% |
| Alloy 490-3 | 11.003 | 0.62 | 0.18 | −0.200% |
| Alloy 41M3 | 10.374 | 0.56 | 0.19 | +0.087% |

*For comparison

TABLE 7

Calculated Compositions of γ (in atomic %) in Equilibrium at 870° C.*

| Alloy | Ni | Al | Co | Cr | Cu | Fe | Hf | Mn | Mo | Nb | Si | Ta | Ti | W | Zr | C |
|---|---|---|---|---|---|---|---|---|---|---|---|---|---|---|---|---|
| Sato-19** | 39.36 | 3.25 | 0 | 13.90 | 0 | 39.06 | 0 | 2.45 | 0.24 | 0 | 0.1 | 0 | 1.6 | 0.04 | 0 | 0.002 |
| Alloy 41M | 33.62 | 3.92 | 1.05 | 19.42 | 0 | 40.87 | 0.002 | 0 | 0 | 0.23 | 0 | 0.09 | 0.79 | 0 | 0 | 0.001 |
| Alloy 66 | 37.93 | 5.82 | 0 | 18.36 | 0 | 32.92 | 0 | 3.82 | 0 | 0 | 0 | 0 | 1.13 | 0.014 | 0 | 0.002 |
| Alloy 67 | 38.32 | 4.93 | 0 | 18.60 | 0 | 34.28 | 0 | 2.75 | 0 | 0 | 0 | 0 | 1.13 | 0 | 0 | 0.002 |
| Alloy 490-2 | 40.23 | 5.22 | 0.02 | 21.47 | 0 | 31.87 | 0.001 | 0 | 0.39 | 0 | 0 | 0.04 | 0.75 | 0 | 0 | 0.004 |
| Alloy 490-3 | 38.14 | 5.19 | 0.02 | 19.98 | 0 | 35.38 | 0.001 | 0 | 0.36 | 0 | 0 | 0.04 | 0.88 | 0.01 | 0 | 0.003 |
| Alloy 41M3 | 36.10 | 4.00 | 1.10 | 21.84 | 0 | 36.04 | 0.001 | 0 | 0 | 0.15 | 0 | 0.07 | 0.69 | 0.01 | 0.001 | 0.001 |

*B, N and other impurities are not included
**For comparison

TABLE 8

Calculated Compositions of γ' (in atomic %) in Equilibrium at 870° C.*

| Alloy | Ni | Al | Co | Cr | Cu | Fe | Hf | Mn | Mo | Nb | Si | Ta | Ti | W | Zr |
|---|---|---|---|---|---|---|---|---|---|---|---|---|---|---|---|
| Sato-19** | 64.39 | 9.09 | 0 | 1.19 | 0 | 9.85 | 0 | 0.62 | 0.02 | 0 | 0 | 0 | 14.82 | 0.02 | 0 |
| Alloy 41M | 63.33 | 11.41 | 0.53 | 1.68 | 0 | 9.80 | 0.06 | 0 | 0 | 3.21 | 0 | 0.79 | 9.18 | 0 | 0 |
| Alloy 66 | 62.82 | 12.77 | 0 | 2.23 | 0 | 9.58 | 0 | 1.09 | 0 | 0 | 0 | 0 | 11.50 | 0.01 | 0 |
| Alloy 67 | 63.76 | 11.85 | 0 | 2.00 | 0 | 9.29 | 0 | 0.74 | 0 | 0 | 0 | 0 | 12.35 | 0 | 0 |
| Alloy 490-2 | 65.83 | 13.32 | 0.01 | 2.27 | 0 | 7.52 | 0.04 | 0 | 0.05 | 0 | 0 | 0.52 | 10.45 | 0 | 0 |
| Alloy 490-3 | 64.68 | 12.85 | 0.01 | 2.08 | 0 | 8.74 | 0.04 | 0 | 0.04 | 0 | 0 | 0.49 | 11.07 | 0.01 | 0 |
| Alloy 41M3 | 64.76 | 11.96 | 0.54 | 1.91 | 0 | 8.22 | 0.04 | 0 | 0 | 2.63 | 0 | 0.67 | 9.26 | 0.01 | 0.002 |

*B, N and other impurities are not included
**For comparison

What is claimed is:

1. An Fe—Ni—Cr alloy consisting essentially of, in terms of wt. %:

Al 2.4 to 3.7
Co up to 1.05
Cr 14.8 to 15.9
Fe 25 to 36
Hf up to 1.2
Mn up to 4
Mo up to 0.6
Nb up to 2.2
Ta up to 1.05
Ti 1.9 to 3.6
W up to 0.08
Zr up to 0.03
C 0.18 to 0.27
N up to 0.0015
balance Ni, wherein, in terms of atomic percent:

$8.5 \leq Al+Ti+Zr+Hf+Ta \leq 11.5$,
$0.53 \leq Al \div (Al+Ti+Zr+Hf+Ta) \leq 0.65$, and
$0.16 \leq Cr \div (Fe+Ni+Cr+Mn) \leq 0.21$,
said alloy being essentially free of Cu, Si, and V.

2. An Alloy in accordance with claim 1 wherein the range of Al is 2.5 to 3.56 weight percent.

3. An Alloy in accordance with claim 1 wherein the range of Co is up to 1.01 weight percent.

4. An Alloy in accordance with claim 1 wherein the range of Cr is 14.93 to 15.76 weight percent.

5. An Alloy in accordance with claim 1 wherein the range of Fe is 25.87 to 35 weight percent.

6. An Alloy in accordance with claim 1 wherein the range of Hf is up to 1 weight percent.

7. An Alloy in accordance with claim 1 wherein the range of Mn is up to 3.38 weight percent.

8. An Alloy in accordance with claim 1 wherein the range of Mo is up to 0.52 weight percent.

9. An Alloy in accordance with claim 1 wherein the range of Nb is up to 2 weight percent.

10. An Alloy in accordance with claim 1 wherein the range of Ta is up to 1.02 weight percent.

11. An Alloy in accordance with claim 1 wherein the range of Ti is 2 to 3.49 weight percent.

12. An Alloy in accordance with claim 1 wherein the range of W is up to 0.06 weight percent.

13. An Alloy in accordance with claim 1 wherein the range of Zr is up to 0.02 weight percent.

14. An Alloy in accordance with claim 1 wherein the range of C is 0.18 to 0.24 weight percent.

15. An Alloy in accordance with claim 1 wherein, in terms of atomic percent, $8.7 \leq Al+Ti+Zr+Hf+Ta \leq 11.48$.

16. An Alloy in accordance with claim 15 wherein, in terms of atomic percent, $9 \leq Al+Ti+Zr+Hf+Ta \leq 11.45$.

17. An Alloy in accordance with claim 1 wherein, in terms of atomic percent, $0.54 \leq Al \div (Al+Ti+Zr+Hf+Ta) \leq 0.64$.

18. An Alloy in accordance with claim 17 wherein, in terms of atomic percent, $0.55 \leq Al \div (Al+Ti+Zr+Hf+Ta) \leq 0.63$.

19. An Alloy in accordance with claim 1 wherein, in terms of atomic percent, $0.17 \leq Cr \div (Ni+Fe+Cr+Mn) \leq 0.20$.

20. An Alloy in accordance with claim 19 wherein, in terms of atomic percent, $0.18 \leq Cr \div (Ni+Fe+Cr+Mn) \leq 0.19$.

* * * * *